US007614920B1

(12) United States Patent
Yi

(10) Patent No.: US 7,614,920 B1
(45) Date of Patent: Nov. 10, 2009

(54) ELECTRICAL CONNECTOR WITH IMPROVED MATING PORT FOR HIGH SPEED SIGNAL TRANSMISSION

(75) Inventor: Chong Yi, Mechanicsburg, PA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/313,213

(22) Filed: Nov. 17, 2008

(51) Int. Cl.
*H01R 33/00* (2006.01)

(52) U.S. Cl. ..... 439/682; 439/692

(58) Field of Classification Search ..... 439/638–639, 439/607, 660, 682, 692
See application file for complete search history.

(56) References Cited

U.S. PATENT DOCUMENTS 5,685,739 A 11/1997 Davis et al.
6,939,177 B2 9/2005 Kato et al.
6,945,824 B1 * 9/2005 Li et al. ..... 439/660
7,021,971 B2 * 4/2006 Chou et al. ..... 439/660

FOREIGN PATENT DOCUMENTS

TW M329889 4/2008

* cited by examiner

*Primary Examiner*—Khiem Nguyen
(74) *Attorney, Agent, or Firm*—Wei Te Chung; Andrew C. Cheng; Ming Chieh Chang

(57) ABSTRACT

An electrical connector includes an insulative housing, a plurality of first and second contacts retained in the housing and a metal shell enclosing the housing. The housing includes a base and a pair of side by side first and second tongue portions extending from the base. The first and the second contacts include flat and elastic contact portions arranged along a front-to-rear direction for high speed signal transmission. The metal shell includes a top wall and a bottom wall with a rectangular receiving space disposed therebetween for enclosing the first and the second tongue portions. Neither the top wall nor the bottom wall comprises a nonelastic protrusion protruding into the receiving space.

20 Claims, 13 Drawing Sheets

ELECTRICAL CONNECTOR WITH IMPROVED MATING PORT FOR HIGH SPEED SIGNAL TRANSMISSION

BACKGROUND OF THE INVENTION

1. Field of the Invention

The present invention relates to electrical connectors, more particularly to electrical connectors for high speed signal transmission.

2. Description of Related Art

There is a trend that electronic devices are designed with high speed data transmission in order to meet demands of end-users. This trend needs connectors mounted on such electronic devices can correspondingly support high data transmission. Infiniband connector is a kind of such connector for high speed data transmission, for example, Infiniband 4X connector can transmit 10 GB/s through four channels each at 2.5 GB/s. However, the number of contacts of the Infiniband 4X connector is multiple as result that the profile of the Infiniband 4X connector is large. Besides, fiber optic connector is another kind of such connector for high speed data transmission. But, it is well-known that fiber optic connector has its own disadvantages such as high cost and very sensitivity to tolerances.

Hence, it is desired to have an electrical connector for high speed data transmission but with low profile and cost in order to solve the problems above.

BRIEF SUMMARY OF THE INVENTION

An electrical connector assembly includes an electrical receptacle and an electrical plug for mating with the electrical receptacle. The electrical receptacle includes an insulative housing, a plurality of conductive contacts and additional contacts retained in the insulative housing and metallic shell enclosing the insulative housing. The insulative housing includes a base and a pair of first and second tongue portions protruding forwardly from the base. The first and the second tongue portions are apart from each other by a gap formed therebetween. The first and second tongue portions are arranged side by side and are coplanar with each other. Each of the first and the second tongue portions has a mating surface defined with a plurality of recessed areas adjacent to a tip of the corresponding first or second tongue portion. The metallic shell is fixed to the base of the insulative housing and comprises an integral receiving space which is essentially rectangular shaped from a front view under a condition that the first and the second tongue portions communicate with each other in the receiving space. Each conductive contact includes an elastic contact portion extending beyond the mating surface and protruding into the receiving space. Each additional contact includes a nonelastic contact portion located forward the elastic contact portion along a rear-to-front direction. The elastic and the nonelastic contact portions are located on a same side of the first or the second tongue portion. The nonelastic contact portions are received in the recessed areas and are exposed to the receiving space.

The electrical plug includes an insulative housing, a first and a second set of contacts retained in the insulative housing, and a rectangular metal shell enclosing the insulative housing. The insulative housing defines a rear portion and a mating portion extending forwardly from the rear portion. The mating portion has a mating surface divided into a first mating section and a second mating section along a rear-to-front direction. A plurality of first passageways extend from the rear portion to the first mating section and are disposed in communicating to the mating surface for receiving the first set of contacts. Each of the first set of contacts has an elastic contact portion movably extending beyond the mating surface. A depression is defined in the second mating section for receiving stiff contact portions of the second set of contacts. The rectangular metal shell is disposed enclosing the mating portion and includes an upper wall, a lower wall and a pair of opposite walls connecting the upper and the lower walls. The stiff contact portions and the elastic contact portions are located on a same side of the mating portion in condition that the elastic contact portions are located behind the stiff contact portions along the rear-to-front direction.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENT

In the following description, numerous specific details are set forth to provide a thorough understanding of the present invention. However, it will be obvious to those skilled in the art that the present invention may be practiced without such specific details. In other instances, well-known circuits have been shown in block diagram form in order not to obscure the present invention in unnecessary detail. For the most part, details concerning timing considerations and the like have been omitted inasmuch as such details are not necessary to obtain a complete understanding of the present invention and are within the skills of persons of ordinary skill in the relevant art.

Figure 1:
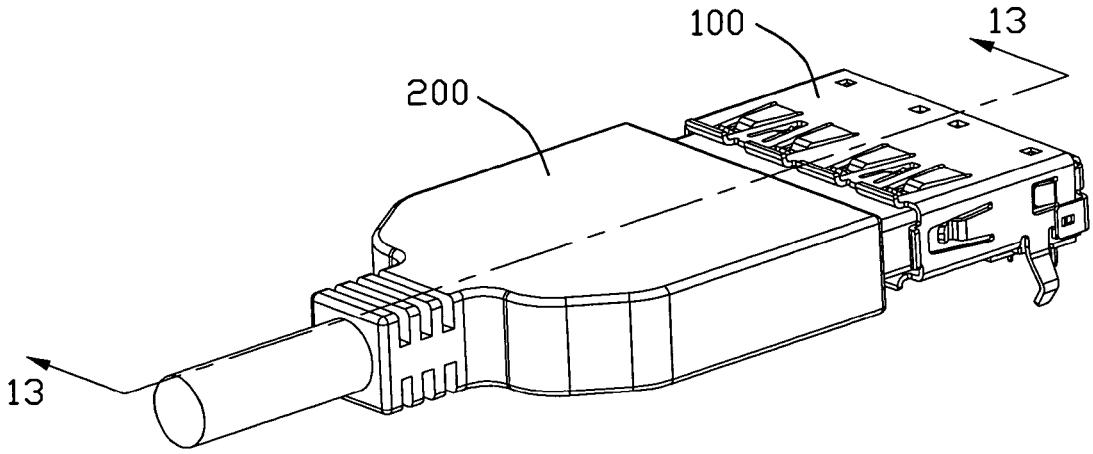
FIG. 1 is a perspective view of an electrical connector assembly with an electrical plug inserted into an electrical receptacle according to the preferred embodiment of the present invention.
Figure 2:
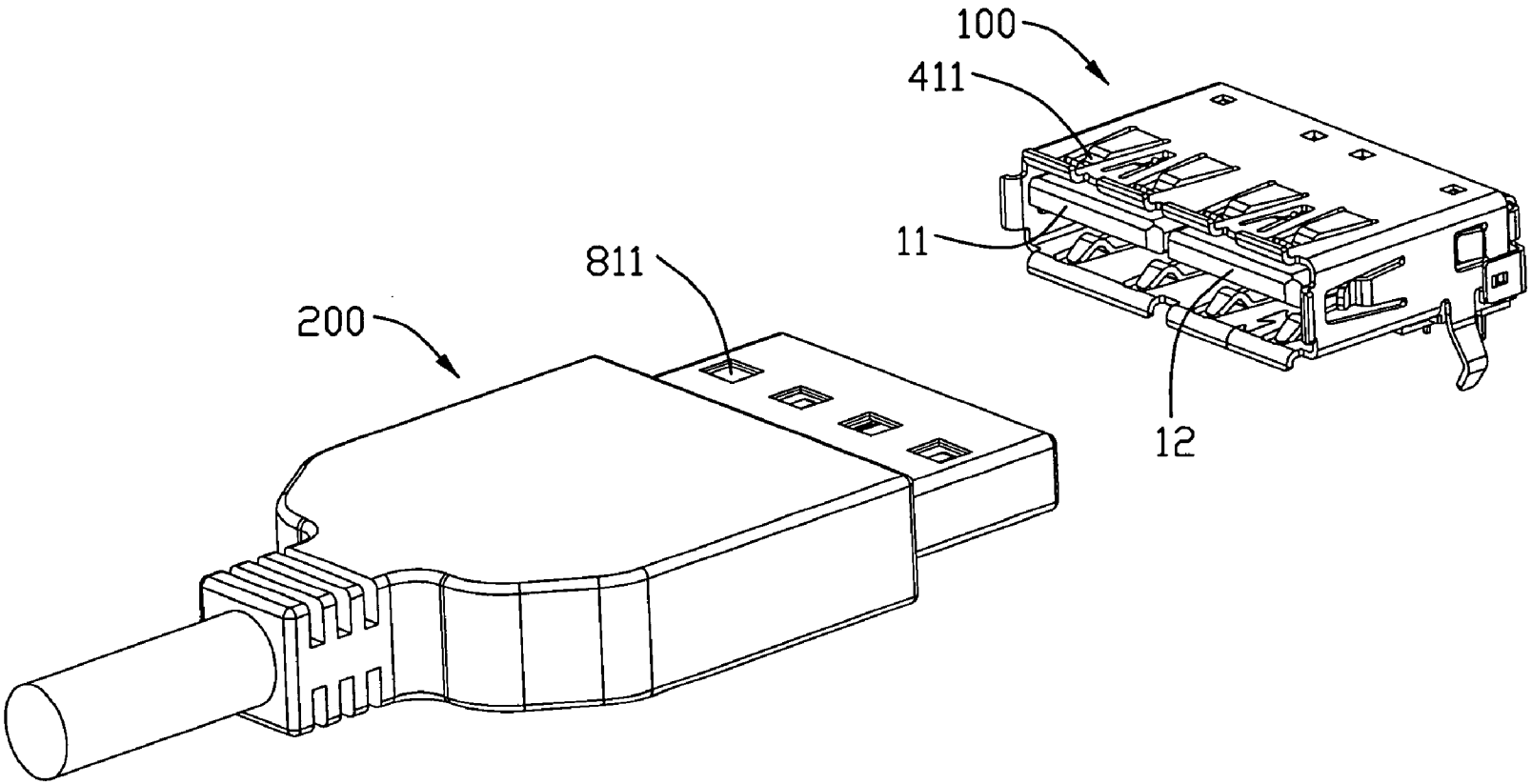
FIG. 2 is a perspective view of the electrical connector assembly showing the electrical plug apart from the electrical receptacle.

Referring to FIGS. 1-2, an electrical connector assembly is disclosed and includes an electrical receptacle 100 and an electrical plug 200 for insertion into the electrical receptacle 100.

In FIGS. 3-6, the electrical receptacle 100 includes an insulative receptacle housing 1, a plurality of receptacle contacts 2 received in the receptacle housing 1, a pair of spacers 3 for organizing the receptacle contacts 2, a front metallic shell 4 enclosing the receptacle housing 1 and a rear metallic shell 5 attached to the front metallic shell 4.

Figure 3:
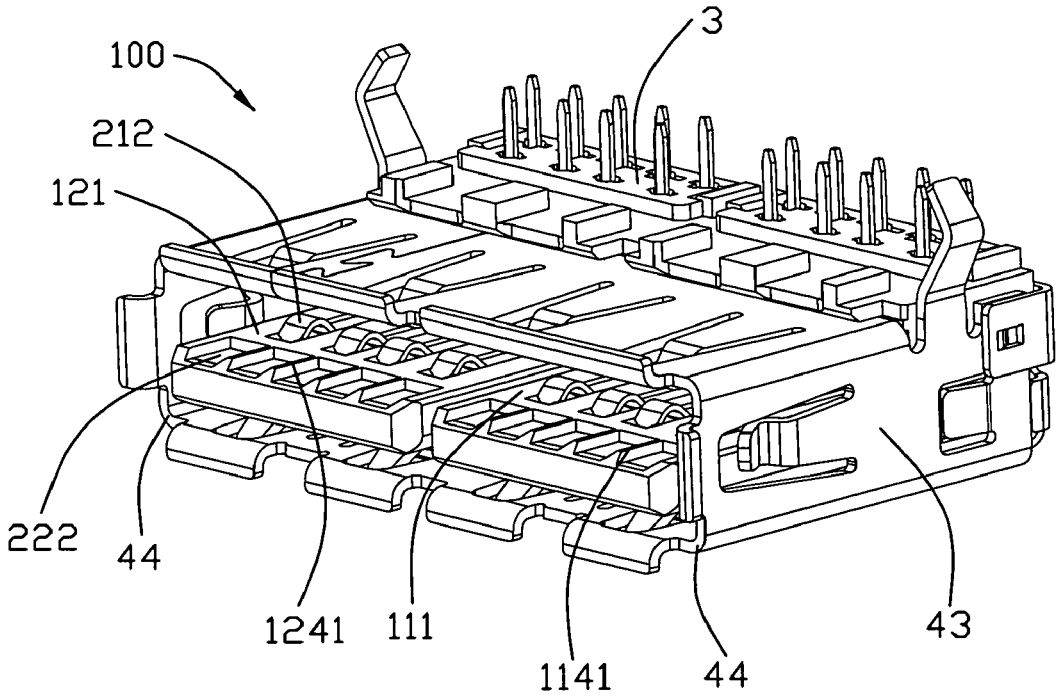
FIG. 3 is a perspective view of the electrical receptacle.
Figure 4:
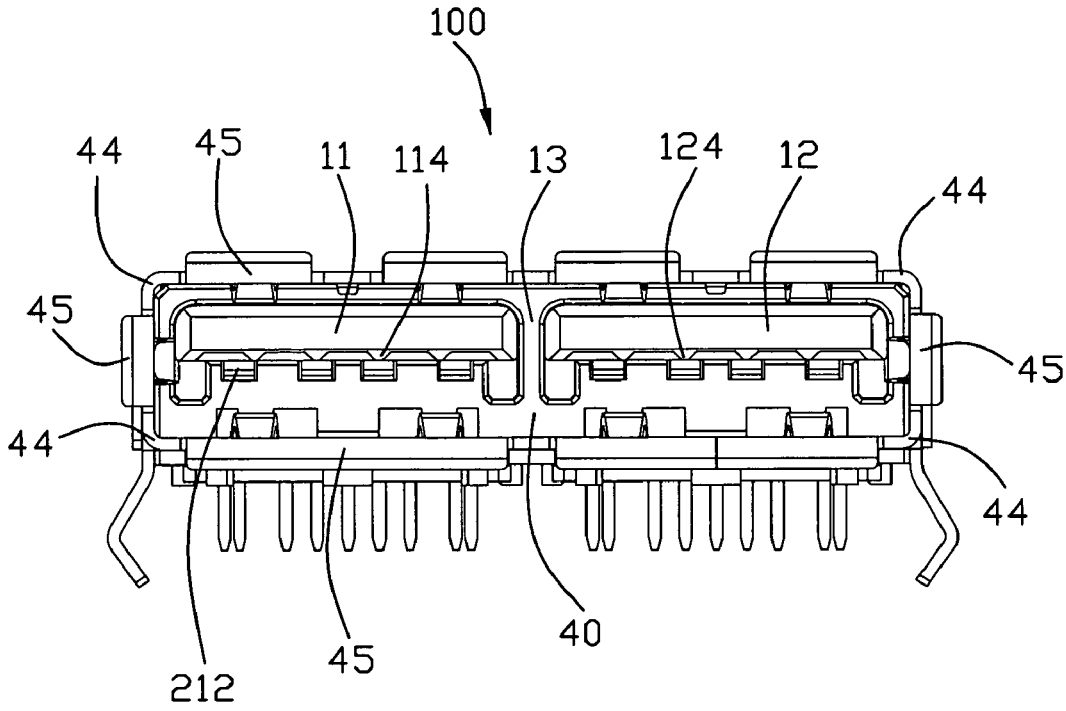
FIG. 4 is a front view of the electrical receptacle shown in FIG. 3.
Figure 6:
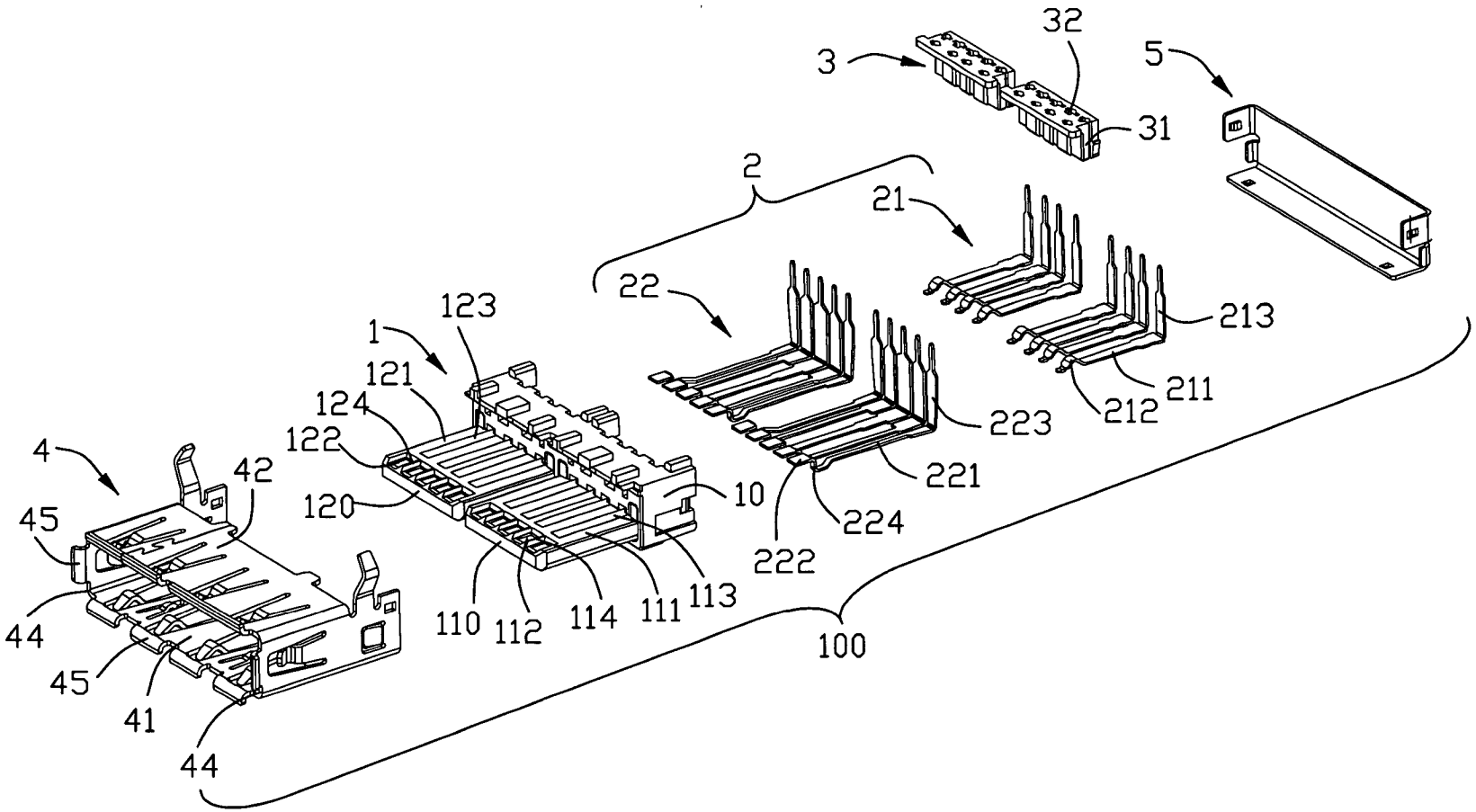
FIG. 6 is another exploded perspective view of the electrical receptacle, but taken from another aspect.

The receptacle housing 1 includes a base 10 and a pair of first and second tongue portions 11, 12 extending forwardly from the base 10. The first and the second tongue portions 11, 12 are arranged side by side and located on a same horizontal level as shown in FIG. 4. A gap 13 is formed between the first and the second tongue portions 11, 12 in order to separate the first and the second tongue portions 11, 12. Each first or second tongue portion 11, 12 includes a mating surface 111, 121 defining a plurality of recessed depressions 112, 122 and a plurality of passageways 113, 123 at the rear of the recessed depressions 112, 122. The passageways 113, 123 further extend backwardly through the base 10 for receiving the corresponding receptacle contacts 2. Each first or second tongue portion 11, 12 includes a tip 110, 120. The recessed depressions 112, 122 is located adjacent to the tip 110, 120. A plurality of raised portions 114, 124 are arranged in condition that each recessed depression 112, 122 is located between the adjacent two raised portions 114, 124. Each raised portion 114, 124 includes an out surface 1141, 1241 coplanar with the mating surface 111, 121, respectively, as best shown in FIGS. 3 and 6. The base 10 and the first and the second tongue portions 11, 12 are assembled to form the receptacle housing 1. However, The base 10 and the first and the second tongue portions 11, 12 can be integrally injecting molded as one piece of the receptacle housing 1.

Figure 5:
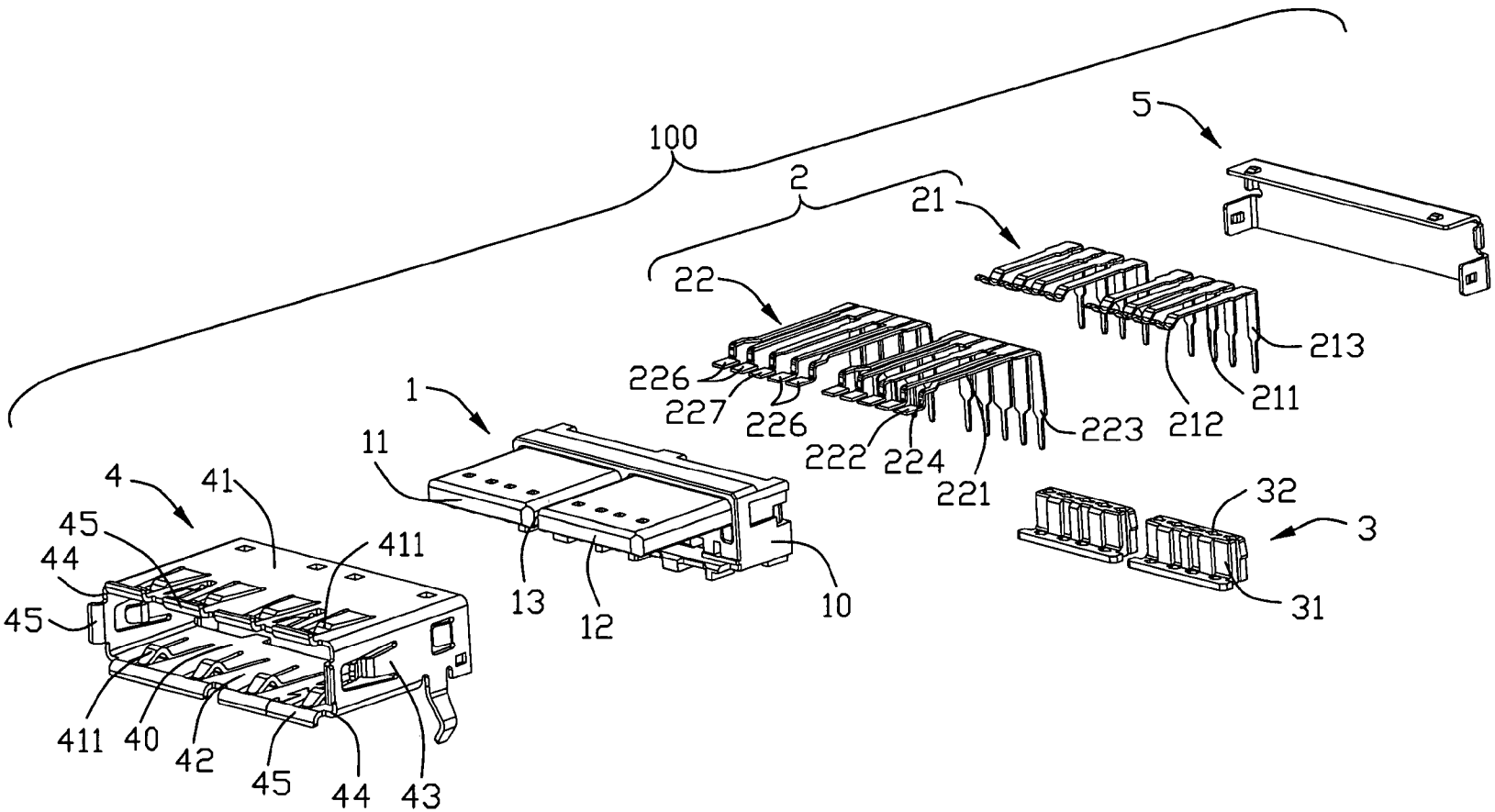
FIG. 5 is an exploded perspective view of the electrical receptacle.

As shown in FIGS. 5-6, the receptacle contacts 2 are divided into two contact groups. Each contact group includes four receptacle conductive contacts 21 and five additional contacts 22. Each of the four receptacle conductive contacts 21 includes a retaining portion 211, a convex elastic contact portion 212 extending forwardly from one end of the retaining portion 211, and a tail portion 213 bending downwardly from the other end of the retaining portion 211. The elastic contact portions 212 extend beyond the mating surface 11. The elastic contact portions 212 are located corresponding to the passageways 113, 123 and can be deformable in the passageways 113, 123. The five additional contacts 22 are insert-molded with the corresponding first and the second tongue portions 11, 12 for easy assembly.

Each of the five additional contacts 22 includes a fixing portion 221, a nonelastic contact portion 222 parallel to the fixing portion 221, a connecting portion 224 connecting the fixing portion 221 and the nonelastic contact portion 222, and a soldering portion 223 bending downwardly from the fixing portion 221. The connecting portion 224 is substantially perpendicular to the nonelastic contact portion 222. The nonelastic contact portion 222 and the fixing portion 221 are located on different horizontal levels among which the nonelastic contact portion 222 is located under the fixing portion 221. The nonelastic contact portion 222 is flat shaped and located in the corresponding recessed depressions 112, 122 as a result that the nonelastic contact portion 222 is located forward the corresponding elastic contact portions 212. As shown in FIG. 3, the raised portions 114, 124 protrude upwardly beyond the nonelastic contact portions 222 in order that the raised portions 114, 124 can prevent the nonelastic contact portions 222 from attaching a metal shell 8 of the electrical plug 200 for ESD (Electrostatic Discharge) protection. The five additional contacts 22 include two pairs of differential receptacle contacts 226 and a grounding receptacle contact 227. The two pairs of differential receptacle contacts 226 are used for transferring/receiving high-speed signals, and the grounding receptacle contact 227 is disposed between the two pairs of differential receptacle contacts 226 for cross-talk protection.

Each of the first and the second tongue portions 11, 12 with the conductive contacts 21 and the additional contacts 22 mounted thereon are of the same configuration and are compatible to Universal Serial Bus Specification, 2.0 Final Draft Revision, Copyright December, 2002. A length of the first or the second tongue portion 11, 12 is the same as that of a standard version 2.0 type-A USB receptacle. A pair of standard version 2.0 type-A USB plugs can be side by side inserted into the electrical receptacle 100 only with the conductive contacts 21 mating with the contacts of the standard version 2.0 type-A USB plugs for signal transmission. In this condition, the additional contacts 22 can't mate with any contact of the standard version 2.0 type-A USB plug and no signal is transmitted by such additional contacts 22.

The tail portions 213 and the soldering portions 223 are perpendicular to each other and located along a vertical direction. Each spacer 3 includes a body portion 31 attached to the base 10 of the receptacle housing and a plurality of through holes 32 through the body portion 31 to receive the tail portions 213 and the soldering portions 223. As a result, the tail portions 213 and the soldering portions 223 can be easily mounted to a PCB (not shown).

As shown in FIGS. 4-6, the front metallic shell 4 is in a tube shape, which defines a top wall 41, a bottom wall 42 opposite to the top wall 41 and a pair of side walls 43 connecting the top wall 41 and the bottom wall 42. A receiving space 40 is jointly formed by the top, the bottom and the side walls 41, 42, 43. The receiving space 40 is rectangular shaped for the first and the second tongue portions 11, 12 protruding thereinto as shown in FIG. 3. The front metallic shell 4 includes a rectangular tip edge 44 and a plurality of guiding extensions 45 extending forwardly from the tip edge 44. The guiding extensions 45 extend outwardly and away from the receiving space 40 for guiding insertion of the electrical plug 200. Each top wall 41 or the bottom wall 42 defines a plurality of springs 411 extending into the receiving space 40 for abutting against the electrical plug 200.

As shown in FIG. 4, the electrical connector 100 is divided into a first port and a second port directly connecting with the first port by the gap 13. The first port includes the first tongue portion 11 and a first contact group together with a part of the front metallic shell 4. The second port includes the second tongue portion 12 and another contact group together with the another part of the front metallic shell 4. Neither the top wall 41 nor the bottom wall 42 includes a nonelastic protrusion located between the first and the second tongue portions 11, 12 and further protruding into the receiving space 40 in order to separate the first port and the second port. As shown in the preferred embodiment of the present invention, the first port and the second port are of the same configuration for easy manufacture.

The electrical plug 200 includes an insulative housing 6, a plurality of contacts 7 mounted to the insulative housing 6, a rectangular metal shell 8 enclosing the insulative housing 6, a cable 9 electrically connecting the contacts 7 and an out grip shell 91 over-molding the metal shell 8 and the cable 9. The grip shell 91 is adapted for grasping by a user when the electrical plug 200 is used. The insulative housing 6 includes a rear portion 61 and a mating portion 62 extending from a front surface of the rear portion 61. The mating portion 62 has a mating surface 63 divided into a first mating section 631 and a second mating section 632 along a rear-to-front direction. The rear portion 61 defines a plurality of first passageways 611 extending forwardly to the first mating section 631 through the mating surface 63. The second mating section 632 defines a pair of first and second depressions 633 through the mating surface 63 and located forward the first passageways 611. The mating portion 62 further includes a unitary flat bottom wall 621 opposite to the mating surface 63, and a pair of side walls 622 connecting the mating surface 63 and the bottom wall 621. A projection 634 is formed on the mating portion 62 and is located between the first and the second depressions 633.

The plurality of contacts 7 include a plurality of first contacts 71 and a plurality of second contacts 72. Each first contact 71 includes a stiff contact portion 711 received in the depressions 633 and a tail end 712 extending backwardly from the stiff contact portion 711 for electrically connected to the cable 9. Each second contact 72 includes an elastic contact portion 721 corresponding to the first passageways 611 and a tail portion 722 extending backwardly from the elastic contact portion 721 for electrically connected to the cable 9. The first and the second contacts 71, 72 are divided into two contact groups of the same configuration and contact arrangement. The two contact groups are separated by the projection 634.

Figure 7:
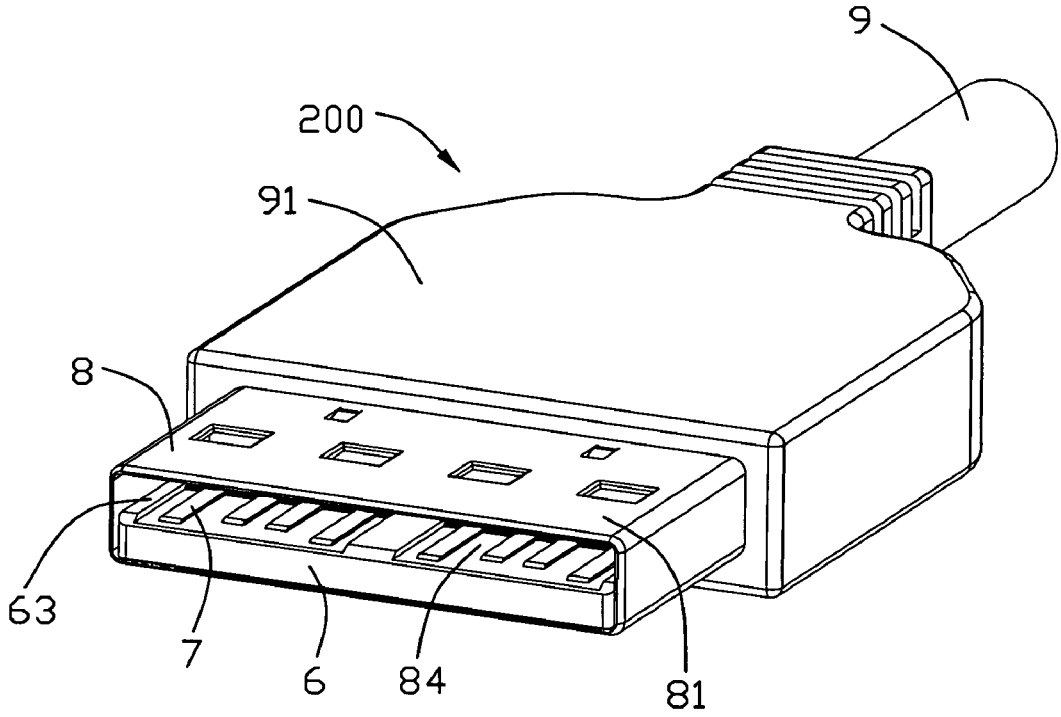
FIG. 7 is a perspective view of the electrical plug.
Figure 8:
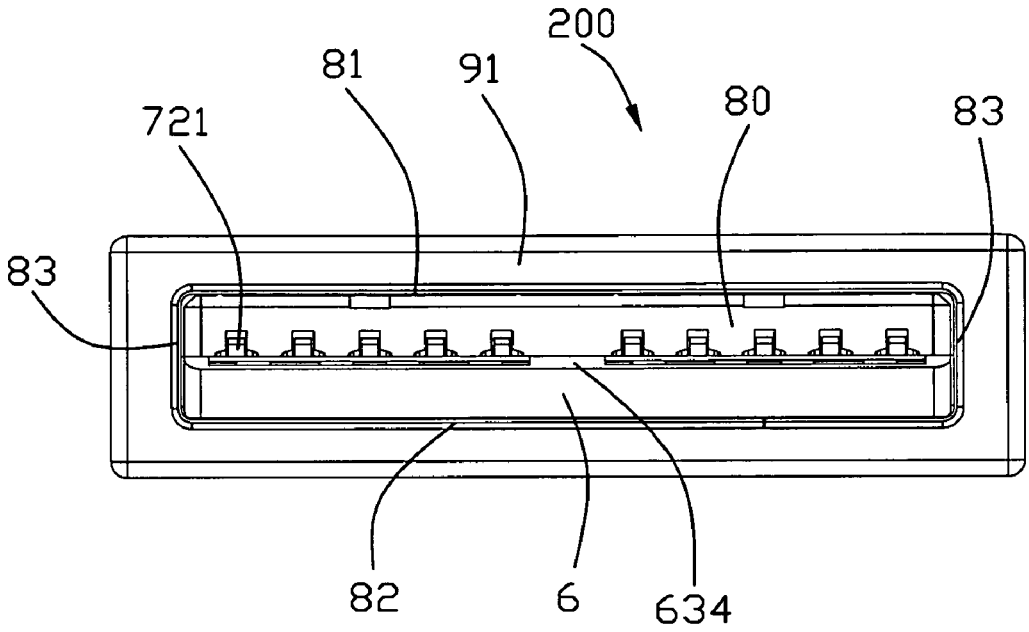
FIG. 8 is a front view of the electrical plug shown in FIG. 7.
Figure 9:
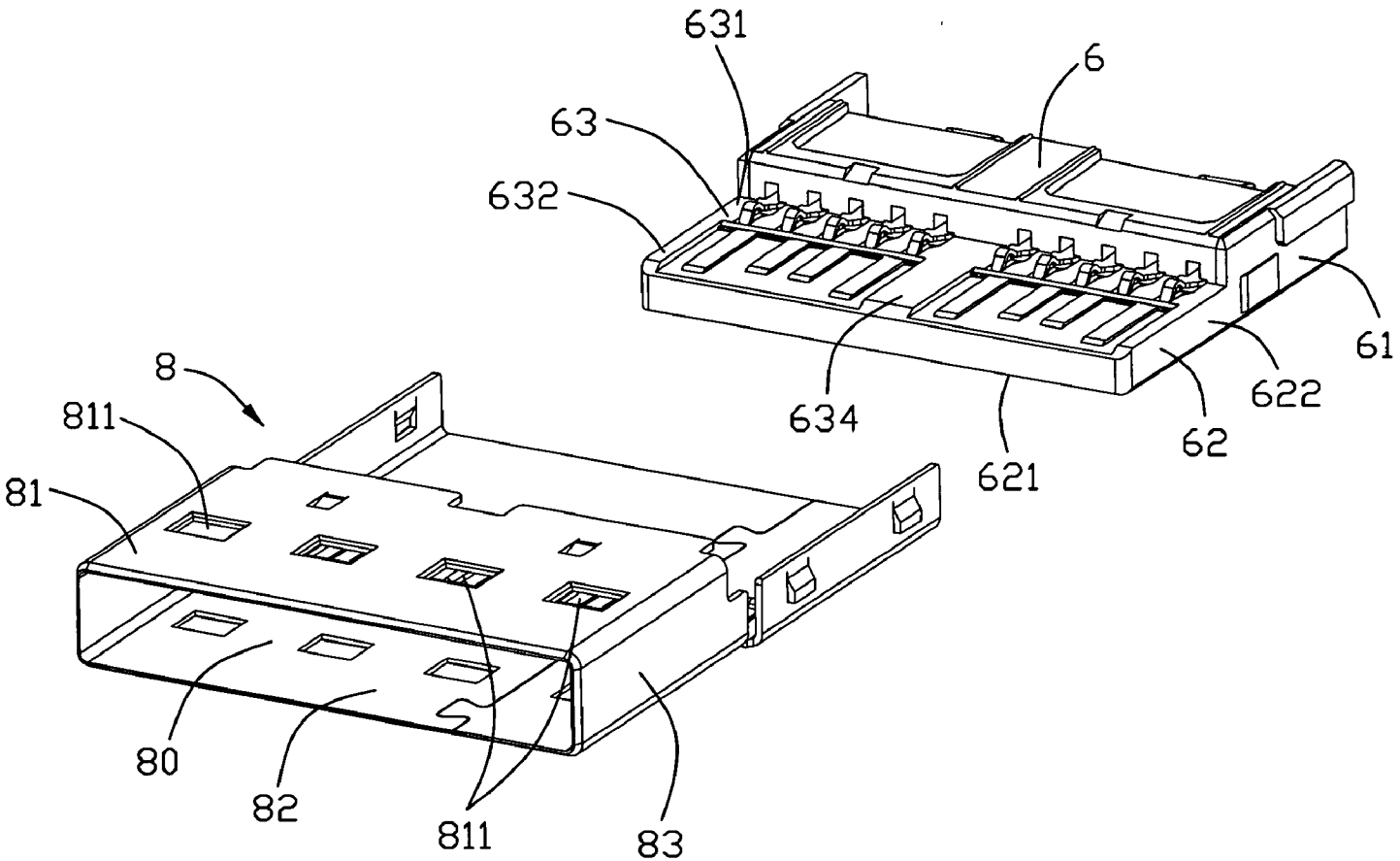
FIG. 9 is a part exploded view of the electrical plug with a grip shell and a cable removed therefrom.
Figure 10:
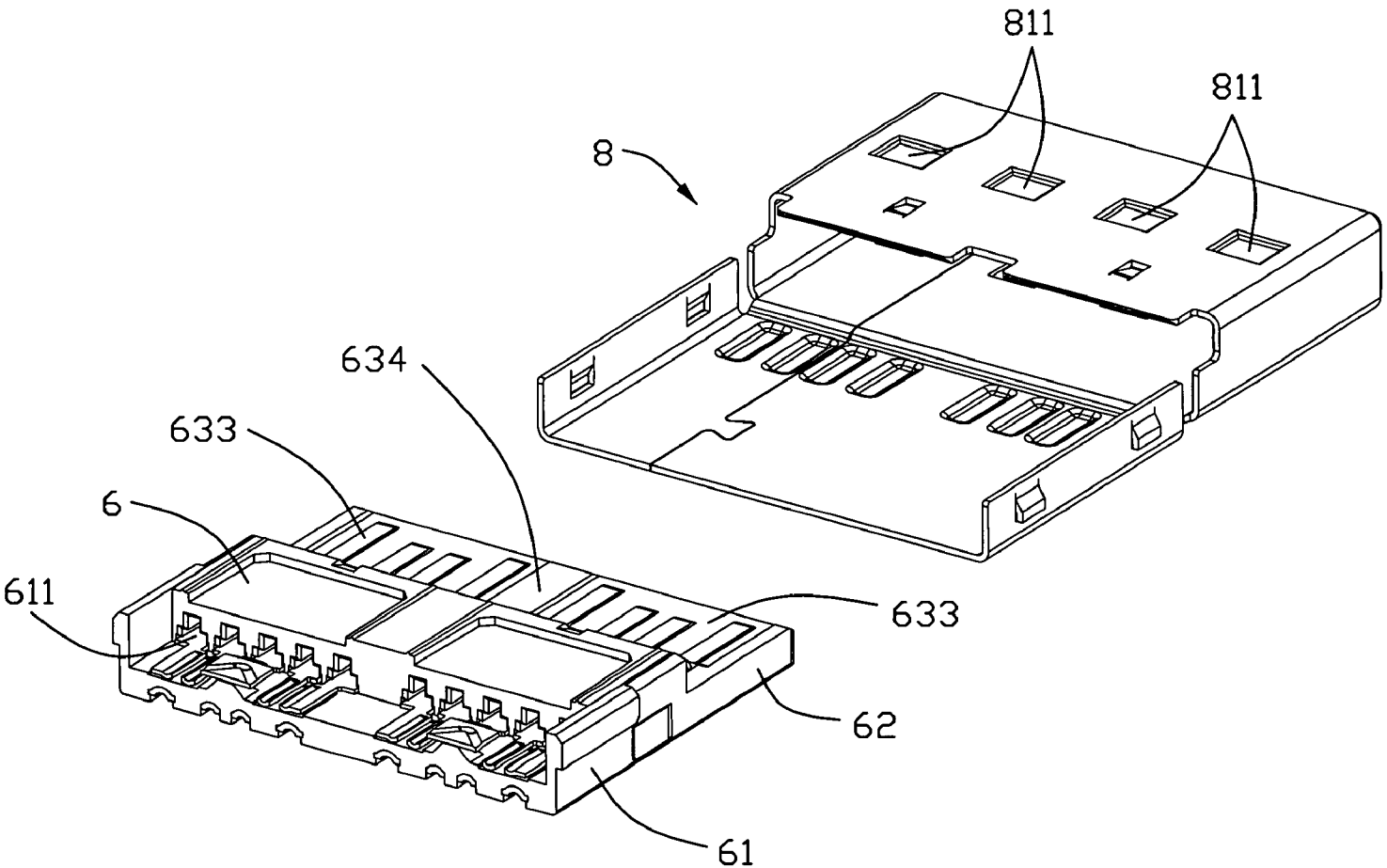
FIG. 10 is another part exploded view of the shown in FIG. 9, while taken from another aspect.
Figure 11:
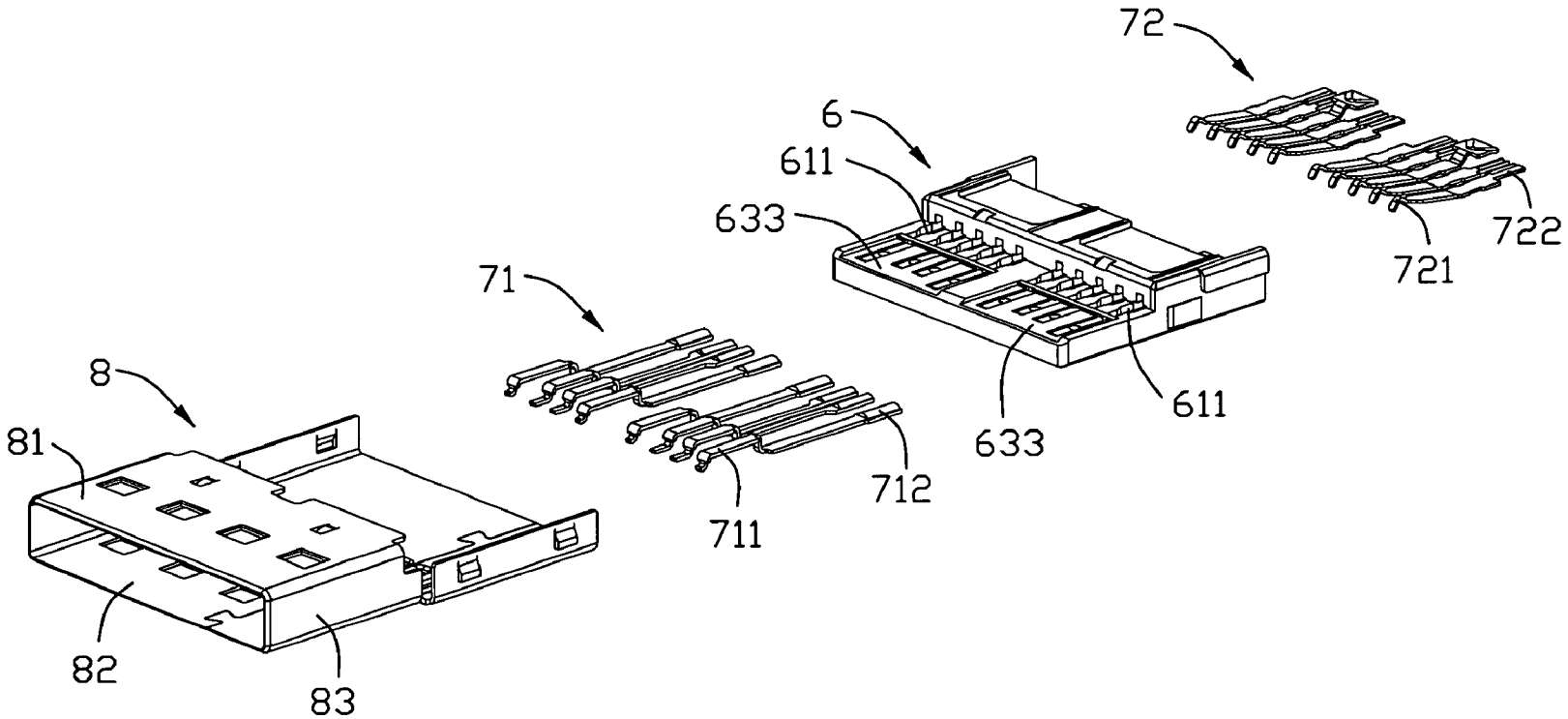
FIG. 11 is an exploded view of the electrical plug shown in FIG. 9.
Figure 12:
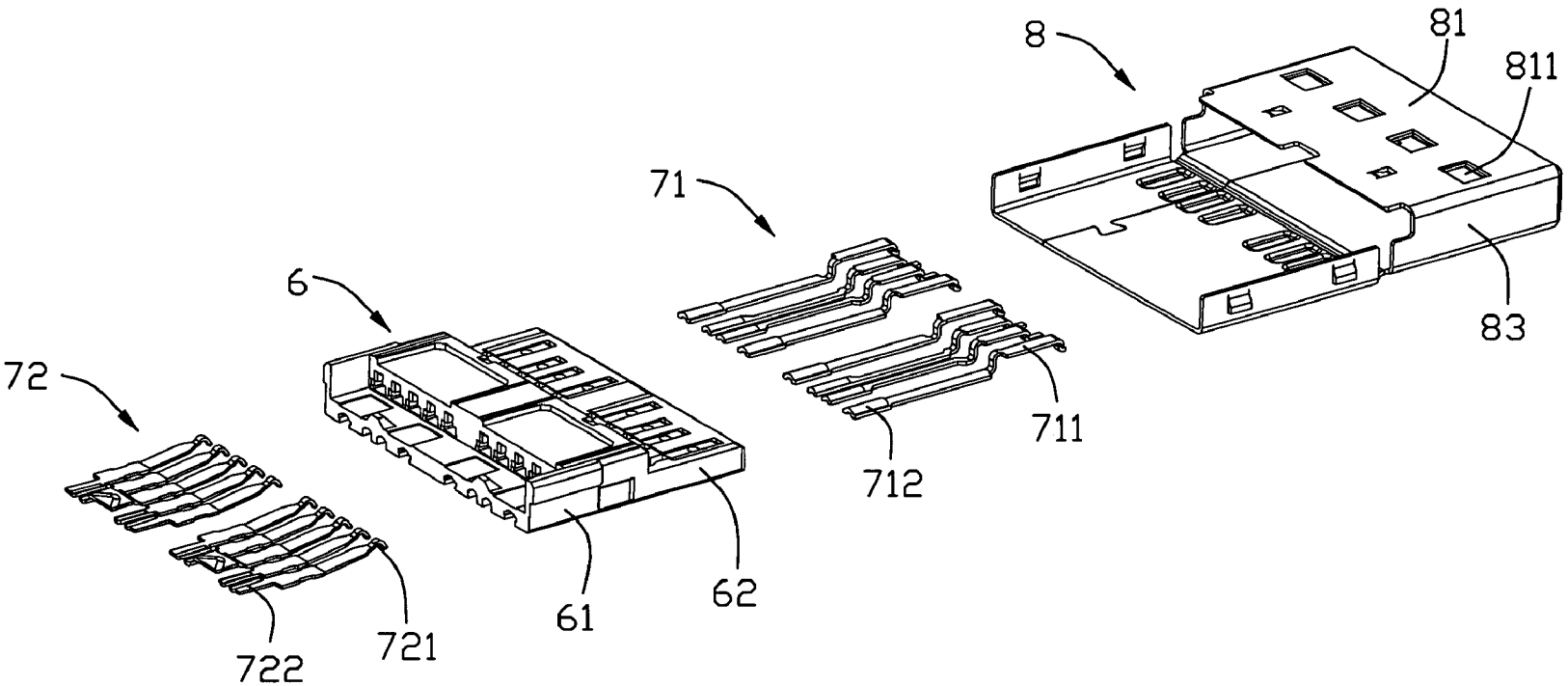
FIG. 12 is another exploded view of the electrical plug shown in FIG. 10, while taken from another aspect.

The metal shell 8 includes a flat upper wall 81, a lower wall 82 and a pair of opposite walls 83 jointly forming a cavity 80 for receiving the mating portion 62. With insertion of the mating portion 62 into the cavity 80, the metal shell 8 abuts against three walls of the mating portion 62 except the mating surface 63 in order to form a receiving chamber 84 between the mating surface 63 and the upper wall 81. As shown in FIG. 7, in detail, the bottom wall 621 abuts against the lower wall 82 of the metal shell 8, and the side walls 622 abut against the opposite walls 83 of the metal shell 8. The upper wall 81 of the metal shell 8 defines two pairs of through holes 811 corresponding to the two contact groups. The two pairs of through holes 811 are arranged in a single line and communicate with the receiving chamber 84. The stiff contact portions 711 are exposed to the receiving chamber 84 and the elastic contact portions 721 protrude into the receiving chamber 84.

Figure 13:
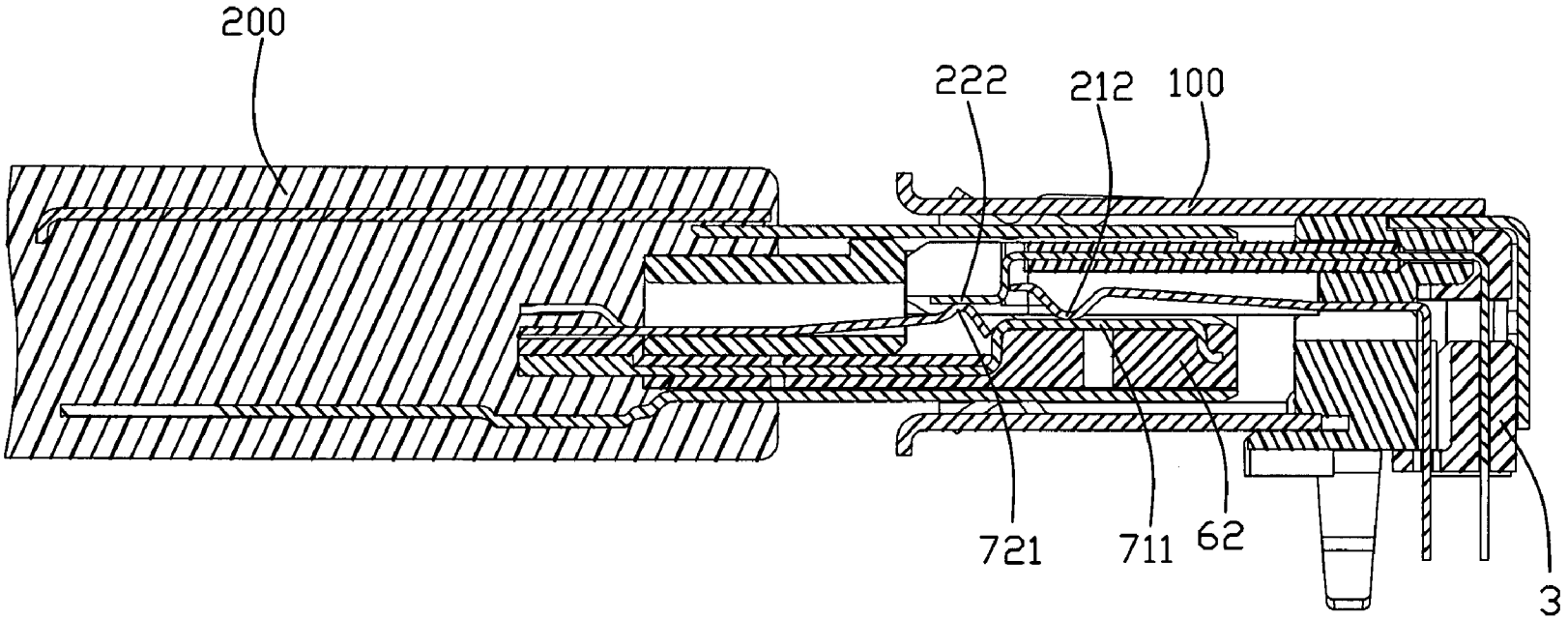
FIG. 13 is a cross-sectional view of the electrical connector assembly taken along line 13-13 of FIG. 1, showing contacts of the electrical plug mating with contacts of the electrical receptacle.

In FIGS. 1-13, a mating status of the electrical plug 200 fully insertion into the electrical receptacle 100 is shown. After the electrical plug 200 is fully inserted into the electrical receptacle 100, the first and the second tongue portions 11, 12 are both received in the receiving chamber 84 of the electrical plug 200. All plug contacts 7 physically contact corresponding receptacle contacts 2 as clearly shown in FIG. 13. Under this condition, the receptacle conductive contacts 21 act as power contacts and abut against the first contacts 71 for power transmission. The additional contacts 22 mate with the second contacts 72 for high signal transmission up to 10 GB/s. Meanwhile, the springs 411 of the front metallic shell 4 engage with corresponding through holes 811 of the metal shell 8 in order to secure the mating state.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed. For example, the tongue portion is extended in its length or is arranged on a reverse side thereof opposite to the supporting side with other contacts but still holding the contacts with an arrangement indicated by the broad general meaning of the terms in which the appended claims are expressed.

I claim:

1. An electrical receptacle, comprising:

an insulative housing including a base and a pair of first and second tongue portions protruding forwardly from the base, the first and the second tongue portions being apart from each other by a gap formed therebetween, the first and second tongue portions being arranged side by side and being coplanar with each other, each of the first and the second tongue portions having a mating surface defined with a plurality of recessed areas adjacent to a tip of the corresponding first or second tongue portion;

a metallic shell fixed to the base of the insulative housing and comprising an integral receiving space which is essentially rectangular shaped from a front view under a condition that the first and the second tongue portions communicate with each other in the receiving space and;

a plurality of conductive contacts each comprising an elastic contact portion extending beyond the mating surface and protruding into the receiving space; and a plurality of additional contacts each comprising a nonelastic contact portion located forward the elastic contact portion along a rear-to-front direction, the elastic and the nonelastic contact portions being located on a same side of the first or the second tongue portion; wherein the nonelastic contact portions are received in the recessed areas and are exposed to the receiving space.

2. The electrical receptacle as claimed in claim 1, wherein the plurality of the conductive contacts and the additional contacts are divided into first and second contact groups with same contact arrangement, an assembly with the first contact group mounted on the first tongue portion being of the same configuration as another assembly with the second contact group mounted on the second tongue portion.

3. The electrical receptacle as claimed in claim 1, wherein a length of each of the first and the second tongue portions is substantially the same as that of a standard version 2.0 type-A Universal Serial Bus (USB) receptacle.

4. The electrical receptacle as claimed in claim 1, wherein the metallic shell comprises a top wall, a bottom wall and a pair of first and second side walls connecting the top and the bottom walls jointly with the receiving space formed therebetween, and wherein both of the top and the bottom walls have a plurality of guiding extensions extending forwardly from a tip edge thereof, the guiding extensions extending outwardly and away from the receiving space.

5. The electrical receptacle as claimed in claim 4, wherein neither the top wall nor the bottom wall comprises a nonelastic protrusion located adjacent to the tip end and protruding into the receiving space.

6. The electrical receptacle as claimed in claim 1, wherein the electrical receptacle is compatible to version 2.0 USB standard.

7. The electrical receptacle as claimed in claim 6, wherein a pair of standard version 2.0 USB plugs can be simultaneously side-by-side accommodated in the receiving space with the first and the second tongue portions mating with said pair of standard version 2.0 USB plugs, respectively.

8. The electrical receptacle as claimed in claim 1, wherein each nonelastic contact portion is flat and comprises an out surface lower than the mating surface of the corresponding first or second tongue portion under a condition when the elastic contact portions upwardly protrude into the receiving space.

9. The electrical receptacle as claimed in claim 8, wherein the first and the second tongue portions comprise a plurality of raised portions in condition that each of the recessed areas is formed between the adjacent two raised portions with the nonelastic contact portions received therein.

10. The electrical receptacle as claimed in claim 1, wherein the plurality of conductive contacts act as power contacts when the first and the second tongue portions jointly mating with a corresponding plug.

11. An electrical plug, comprising:

an insulative housing defining a rear portion and a mating portion extending forwardly from the rear portion, the mating portion having a mating surface divided into a first mating section and a second mating section along a rear-to-front direction;

a plurality of first passageways extending from the rear portion to the first mating section and in communicating to the mating surface;

a depression defined in the second mating section;

a first set of contacts received in the first passageways, and each having an elastic contact portion movably extending beyond the mating surface; and a second set of contacts each having a stiff contact portion securely retained in the depression; and a rectangular metal shell with a plurality of peripheral walls enclosing the mating portion, the peripheral walls comprising an upper wall, a lower wall and a pair of opposite walls connecting the upper and the lower walls in condition that the peripheral walls abut against the mating portion except the upper wall, wherein the stiff contact portion and the elastic contact portion are located on a same side of the mating portion in condition that the elastic contact portion is located behind the stiff contact portion along the rear-to-front direction.

12. The electrical plug as claimed in claim 11, wherein the first and the second set of contacts are divided into two contact groups of the same configuration and contact arrangement, among which the second set of contacts in each group act as power contacts.

13. The electrical plug as claimed in claim 12, wherein a receiving chamber is formed between the mating surface and the upper wall of the metal shell under a condition that the stiff contact portions are exposed to the receiving chamber and the elastic contact portions protrude into the receiving chamber.

14. The electrical plug as claimed in claim 13, wherein the upper wall of the metal shell defines two pairs of through holes corresponding to the two contact groups, the two pairs of through holes being arranged in a single line and communicating with the receiving chamber.

15. The electrical plug as claimed in claim 13, wherein the mating portion comprises a unitary flat bottom wall abutting against the lower wall of the metal shell.

16. An electrical connector assembly comprising:

a receptacle connector including:

a first insulative housing defining two spaced mating tongues each being of a USB protocol;

a plurality of first contacts disposed upon each of said mating tongues;

a first shell enclosing said first housing and defining a plurality of first walls commonly defining a first receiving space surrounding both said mating tongues; and a plug connector including:

a second insulative housing defining a projecting mating portion having a common mating platform thereof with thereon two spaced mating areas each being of the USB protocol;

a plurality of second contacts disposed upon each of said mating areas and respectively connected to corresponding wires;

a second shell enclosing said second housing and defining a plurality of second walls commonly defining a second receiving space surrounding said mating portion with corresponding internal receiving cavities adjacent to said mating portion; wherein during mating, the two spaced mating tongues are respectively received in the corresponding receiving cavities, and on the other hand the mating portion with the corresponding surrounding second walls are received in the first receiving space inside the first shell.

17. The electrical connector assembly as claimed in claim 16, wherein in the receptacle connector, no items is located between said two spaced mating tongues to isolate said two spaced mating tongues in a transverse direction, at least when said receptacle connector is mated with the plug connector.

18. The electrical connector assembly as claimed in claim 17, wherein no item is located between said two spaced mating tongues to isolate said two spaced mating tongue in said transverse direction, even when said receptacle is alone without mating with the plug connector.

19. The electrical connector assembly as claimed in claim 16, wherein in the plug connector, no item is located between the corresponding receiving cavities to isolate the corresponding receiving cavities in a transverse direction, at least when said plug connector is mated with the plug connector.

20. The electrical connector assembly as claimed in claim 19, wherein no item is located between the corresponding receiving cavities to isolate the corresponding receiving cavities in said transverse direction, even when said plug connector is alone without mating with the receptacle connector.

* * * * *